US008297092B2

(12) United States Patent
Tange et al.

(10) Patent No.: US 8,297,092 B2
(45) Date of Patent: Oct. 30, 2012

(54) REFLECTION MEMBER FOR SHOT PEENING AND SHOT PEENING METHOD HAVING THE SAME

(75) Inventors: Akira Tange, Yokohama (JP); Masato Sugawara, Kohka (JP); Isao Sumiyoshi, Yokohama (JP); Ken Takahashi, Yokohama (JP); Yutaka Wakabayashi, Yokohama (JP); Masayoshi Kawai, Yokohama (JP)

(73) Assignee: NHK Spring Co., Ltd., Yokohama (JP)

( * ) Notice: Subject to any disclaimer, the term of this patent is extended or adjusted under 35 U.S.C. 154(b) by 233 days.

(21) Appl. No.: 12/734,588

(22) PCT Filed: Nov. 14, 2008

(86) PCT No.: PCT/JP2008/070776

§ 371 (c)(1),
(2), (4) Date: May 19, 2010

(87) PCT Pub. No.: WO2009/066617

PCT Pub. Date: May 28, 2009

(65) Prior Publication Data

US 2010/0281938 A1 Nov. 11, 2010

(30) Foreign Application Priority Data

Nov. 20, 2007 (JP) ..... 2007-300472

(51) Int. Cl.
*C21D 7/06* (2006.01)

(52) U.S. Cl. ..... 72/53

(58) Field of Classification Search ..... 72/53
See application file for complete search history.

(56) References Cited

U.S. PATENT DOCUMENTS 1,590,573 A * 6/1926 Frye et al. ..... 446/266
7,178,212 B2 * 2/2007 Baiker ..... 29/90.7

FOREIGN PATENT DOCUMENTS

| | | |
|---|---|---|
| CN | 1986161 A | 6/2007 |
| JP | A-05-138535 | 6/1993 |
| JP | A-07-276232 | 10/1995 |
| JP | A-2002-137166 | 5/2002 |
| JP | A-2004-74309 | 3/2004 |

OTHER PUBLICATIONS

International Search Report issued in PCT/JP2008/070776, mailed on Mar. 3, 2009 (with translation).
"The Shot Peener Summer 2004," The Shot Peener-Summer 2004, Proceedings of the 8th International Conference on Shot Peening, p. 9.
Chinese Office Action issued in Chinese Patent Application No. 200880117876.7 dated Sep. 15, 2011 (with translation).
Apr. 16, 2012 Office Action issued in Chinese Patent Application No. 200880117876.7 (with English Translation).

* cited by examiner

*Primary Examiner* — Faye Francis
(74) *Attorney, Agent, or Firm* — Oliff & Berridge, PLC

(57) ABSTRACT

The reflection portion of the reflection member is moved along the inner surface in the hole of the pipe from the entrance opening of the hole of the pipe to the exit opening of the hole thereof. In this case, the reflection portion is guided by the guide portion provided at both sides of the reflection portion. The shots, which are projected toward the inner surface in the hole of the pipe, reach the reflection portion through the holes of the guide portion of the entrance side, and they are reflected toward the inner surface in the hole of the pipe. Since the shots can be reflected toward the inner surface inside in the hole of the pipe, the tendency that shots may be moved toward the inner surface outside in the hole of the curved portion can be small.

8 Claims, 5 Drawing Sheets

REFLECTION MEMBER FOR SHOT PEENING AND SHOT PEENING METHOD HAVING THE SAME

TECHNICAL FIELD

The present invention relates to a reflection member for shot peening and a shot peening method having the reflection member. In particular, it relates to an improvement in a technique of projection of shots toward an inner surface of a hole of a pipe.

BACKGROUND ART

In a shot peening method, shots are projected toward a surface of a work, so that a clean surface is formed by removal of the surface or a compressive residual stress is provided to the surface by plastic deformation thereof. In this manner, the shot peening method is advantageous for improvement in the life-span and the reliability of the work. A direct pressure type device in which shots are injected and carried by a compressive gas, and a suction type device in which shots are included in a gas flow having a pressure difference, are used as a projection device of shot peeing.

The shot peening method is used for a pipe (for example, a hollow stabilizer or a hollow coil spring) having a hole. In a pipe, a wall thereof is thinned in order to reduce the weight thereof. The pipe may not be broken from an outer surface that is typically subjected to shot peening, but it may be broken from an inner surface thereof. Therefore, the inner surface is subjected to shot peening, so that the weight reduction by thinning of wall of pipe and the life-span extension may be simultaneously improved.

In this shot peening method, various special members are used for projecting shots toward an inner surface of a hole of a pipe. For example, in a technique proposed in Shotpeener Summer 2004, a hose is provided as a special member at a shot projection side opening of a nozzle, and it is disposed in an inner surface of a hole of a pipe.

However, in the technique proposed in Shotpeener Summer 2004, the hose cannot pass along the inner surface in the hole, depending on an inner diameter of the hole of the pipe and a shape thereof. In this case, when the inner diameter of the horse is small, projection amount of shots is decreased. Due to this, it is necessary to exchange a hose in accordance with the inner diameter of the hole of the pipe and the shape thereof, so that exchange of setting of shot peening apparatus is necessary. Thus, since time is consumed and cost is increased, the workability and the general versatility are insufficient.

In order to solve the above problem, Japanese Unexamined Patent Application Publication No. H5-138535 has proposed that a reflection member is provided as a special member in an inner surface of a hole of a rod-shaped pipe so as to face an entrance opening of a nozzle. In this technique, the pipe is moved by a moving device along an axial direction of the pipe, so that the reflection member is moved relatively to the inner surface in the hole of the pipe.

However, in the technique proposed in Japanese Unexamined Patent Application Publication No. H5-138535, the overall of the pipe is moved relatively to the nozzle and the reflection member, so that it is difficult to apply this technique to a hole of a pipe having a curved portion.

In stead of a shot peeing method, for example, Japanese Unexamined Patent Application Publication No. 2002-137166 has proposed a technique that a compressive residual stress is provided to an inner surface of a hole of a pipe by using a surface enhancement apparatus. In the surface enhancement apparatus of this technique, a shaft portion and a collision element connected thereto are rotated, and the collision element is collided on the inner surface in the hole of the pipe. However, in consideration of practical use, it is difficult to realize this technique.

DISCLOSURE OF THE INVENTION

An object of the present invention is to provide a reflection member for shot peening and a shot peening method having the reflection member, which can improve the workability and the versatility, and which can be easily used on an inner surface of a hole of a curved portion of a pipe.

According to one aspect of the present invention, a reflection member for shot peening is used for reflecting shots projected in the shot peening. The reflection member includes: a wire; a reflection portion that is provided around the wire and reflects the shots; a guide portion that is fixed at both sides of the reflection portion around the wire and has a hole through which the shots pass in an axial direction of the wire.

In the aspect of the present invention, the reflection portion is provided around the wire, and the guide portion is fixed at both sides of the reflection portion around the wire. Thus, when the reflection portion is disposed on the inner surface in the hole of the pipe, the reflection portion is positioned within a predetermined range from the axis of the pipe in the hole thereof. When shots are projected from an entrance opening of the hole of the pipe in which the reflection member is disposed on the inner surface in the above manner, the shots reaches the reflection portion through the hole of the guide portion at the entrance side, and they are thereby reflected toward the inner surface in the hole of the pipe. After the shots are collided to the inner surface in the hole of the pipe, the shots are ejected from the exit opening through the hole of the guide portion at the exit side.

Since the shots are reflected by the reflection member toward the inner surface in the hole of the pipe in this manner, the flow of the shots can be controlled by appropriately setting of the formation position, the inclined angle of reflection surface of the reflection portion, and so forth. Thus, the shot peening can be performed onto a desired portion of the inner surface in the hole of the pipe. When the wire is moved on the inner surface in the hole of the pipe in the projection of the shots, the shot peening can be performed onto plural desired portions, or the shot peening can be sequentially performed onto a desired region along the axial direction of the hole of the pipe.

The effects of the reflection member of the present invention can be maximally exerted when the reflection member is used for a pipe having a curved portion. In the conventional technique, as shown in FIG. 9, when a curved portion P is formed on the pipe W, the flow of the shots is positioned eccentrically toward an outside $P_2$ of inner surface (that is, an inner surface outside $P_2$) of hole at the curved portion P by centrifugal force or the like. Due to this, the shot peening may be sufficiently performed onto the inner surface outside $P_2$ of hole at the curved portion P, but an inside $P_1$ of inner surface (that is, an inner surface inside $P_1$) of hole at the curved portion P may be insufficiently performed. In FIG. 9, an arrow direction f denotes a locus of shots passing through the inner surface outside from the entrance opening of the pipe W to the curved portion P, and an arrow direction f' denotes a locus of shots passing through the inner surface inside from the entrance opening of the pipe W to the curved portion P.

In contrast, as shown in FIG. 4, in the reflection member 1 of the present invention, when the reflection portion 20 provided around the wire 10 passes through the curved portion P in the projection of the shots, the shots can be reflected by the reflection surface toward the inner surface inside of hole at the curved portion by appropriately setting of the formation position of the reflection portion, the inclined angle of reflection surface thereof, and so forth. Thus, since the tendency that shots may be moved toward the inner surface outside in the hole of the curved portion P can be small, the processed condition of the inner surface of the pipe W can be uniform. As a result, thinning of the wall of the pipe W can be performed, the pipe W can be strong, and the weight reduction of the pipe W can be simultaneously performed. In FIG. 4, reference numeral 40 denotes a fixing means for a guide portion 30.

In the reflection member 1 of the present invention, in order to obtain the above effects by the shot peening, the function of the guide portion 30 is important when the guide portion 30 passes through the curved portion P. If the guide portion 30 is not provided at both sides of the reflection portion 20 around the wire 10, the reflection portion 20 is positioned eccentrically toward the inner surface inside of hole at the curved portion P in the same manner as the locus of the wire 10 shown in FIG. 8 when passing through the curved portion P. Due to this, a space is small between the reflection portion 20 and the inner surface inside of hole of the curved portion P, so that it is difficult to obtain the reflection effects by the reflection portion 20.

In contrast, in the reflection member of the reflection member, as shown in FIG. 4, since the guide portion 30 is fixed at both sides of the reflection portion 20 around the wire 10, the locus of the reflection portion 20 when passing through the curved portion P can be set at a desired position (for example, a position proximate to the center of inner diameter of the hole at the curved portion P) by appropriately setting of the formation position of the reflection portion, the inclined angle of reflection surface thereof, and so forth. Therefore, the reflection effects by the reflection portion 20 can be obtained, so that the above effects by the shot peening can be obtained.

In this embodiment, the shot peening can be effectively performed onto the desired positions of the inner surface in the hole of the pipe, and this effect can be obtained by using the simple structure that the reflection portion and the guide portion are provided around the wire. Since the movement of the reflection portion and the guide portion in the hole of the pipe can be performed by using the wire, it is unnecessary to change the projection amount of the shots in accordance with the shape of the pipe. As a result, the workability and the versatility can be improved, and the reflection member can be easily used on the inner surface in the hole of the pipe having the curved portion.

According to a preferred embodiment of the present invention, the reflection member can use various constructions in order to perform the shot peening effectively. For example, the reflection portion can be rotatably provided around the wire. In this feature, the reflection portion appropriately can rotate around the wire when receiving the impacts by shots, gas pressure, or the like, the reflection by the reflection portion can be efficiently performed.

According to another aspect of the present invention, a shot peening method includes the reflection member of the present invention, and the reflection member reflects shots toward the inner surface of the pipe. In the aspect of the present invention, the same effects as those of the reflection member of the present invention can be obtained.

According to a preferred embodiment of the present invention, the shot peening method can use various constructions in order to perform the shot peening effectively. For example, in the shot peening method, the hole of the pipe may have two openings at both sides of the pipe. In projection of the shots, the shots may be injected from one (entrance opening) of the openings to the inner surface by using an injection device, and the shots ejected from another (exit opening) of the openings may be collected by a collection device. In this case, amount of gas collected by the collection device is desirably controlled to be not less than amount of gas injected by the injection device. In general, the movement speed of the shots may be decreased in accordance with the movement of the shots moving from the entrance opening to the exit opening in passing along the inner surface of the hole of the pipe. However, in the above feature of the present invention, since the amount of the gas collected by the collection device is controlled to be not less than amount of gas injected by the shot projection device, the decrease in the movement speed of the shots on the inner surface in the hole of the pipe can be inhibited, so that the shot peening can be effectively performed.

EFFECTS OF THE INVENTION

According to the reflection member for shot peening and the shot peening method using it, the workability and the versatility can be improved, and the reflection member can be easily used on the inner surface in the hole of the pipe having the curved portion.

EXPLANATION OF REFERENCE NUMERALS

Figure 1:
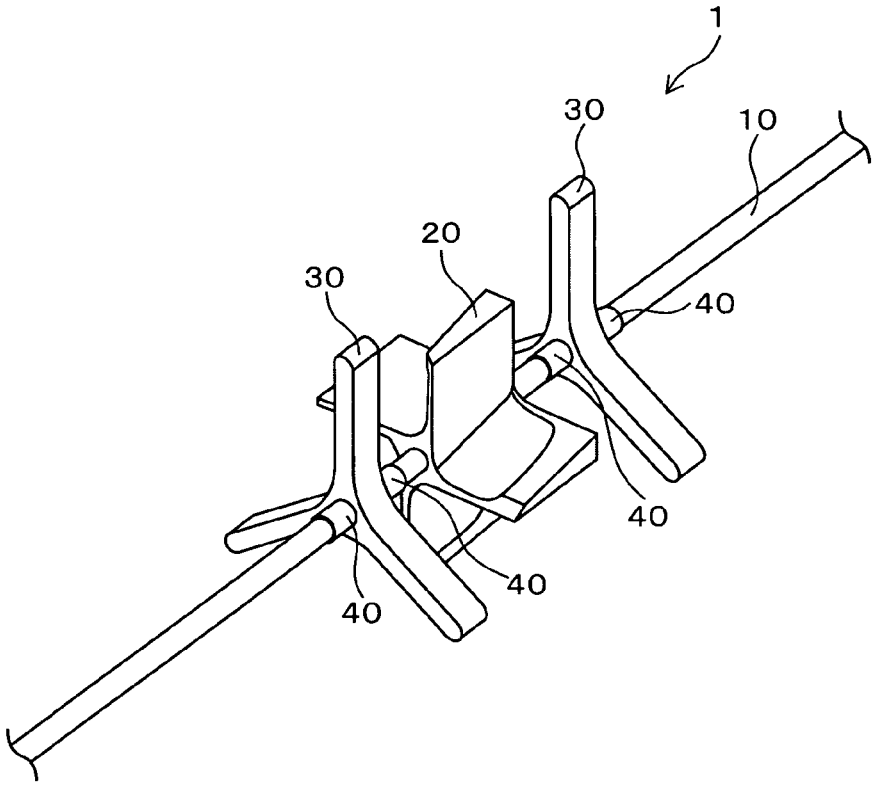
FIG. 1 is a perspective view showing a structure of a reflection member of one embodiment according to the present invention.

Reference numeral 1 denotes a reflection member, reference numeral 10 denotes a wire, reference numeral 20 denotes a reflection portion, reference numeral 30 denotes a guide portion, reference numeral 33 denotes a shot pass hole, reference numeral 120 denotes a shot projection device (injection device), reference numeral 170 denotes a collection device (collection device), reference symbol P denotes a curved portion, and reference symbol W denotes a pipe.

BEST MODE FOR CARRYING OUT THE INVENTION

1. Construction of Embodiment

A. Construction of Reflection Member

Figure 2:
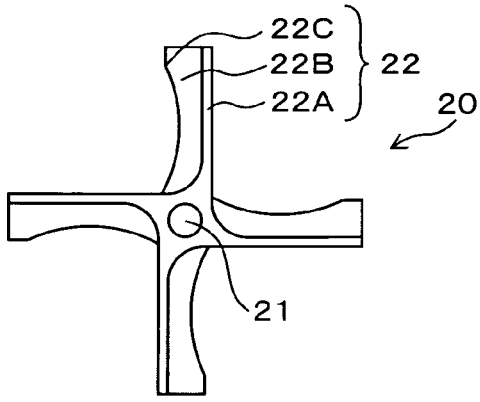
FIG. 2 is a front view showing a reflection portion of a reflection member shown in FIG. 1.
Figure 3:
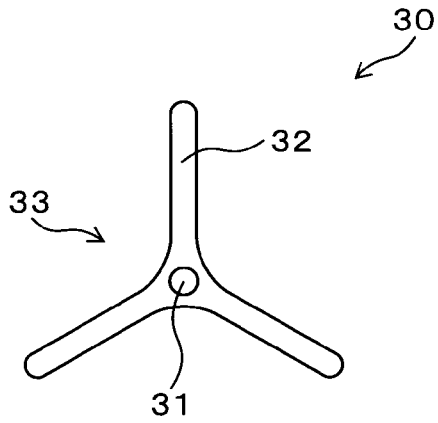
FIG. 3 is a front view showing a guide portion of a reflection member shown in FIG. 1.

One embodiment of the present invention will be explained hereinafter with reference to drawings. FIG. 1 is a perspective view showing a structure of a reflection member 1 of one embodiment according to the present invention. FIG. 2 is a front view showing a reflection portion 20 of the reflection member 1 shown in FIG. 1. FIG. 3 is a front view showing a guide portion 30 of the reflection member 1 shown in FIG. 1. The reflection member 1 is equipped with a wire 10. The reflection portion 20 reflecting shots is rotatably provided around the wire 10. The guide portions 30 guiding the reflection portion 20 are fixed at both sides of the reflection portion 20 around the wire 10. For example, a crimp pin 40 is used as a means for fixing of the guide portion 30 to the wire 10. The wire 10 is a hyperelastic wire or the like, which is desirably wear-resistant and is elastic so as to move in a curved pipe.

As shown in FIG. 2, for example, the reflection member 20 has a wire hole 21 and blade portions 22. The wire 10 penetrates the wire hole 10. The blade portions 22 extend from the wire hole 21 to the outside of radial direction. For example, the blade portions 22 are rotationally symmetric with respect to the wire hole 21. For example, the number of the blade portions 22, which are spaced 90 degrees from each other, is four. Each blade portion 22 has a front end portion 22A, a tapered portion 22B, and a back end portion 22C. The back end portion 22C has a cross section larger than that of the front end portion 22A. The tapered portion 22B has an inclined surface that smoothly connects the front end portion 22A and the back end portion 22C, and the tapered portion 22B is thicker from the front end portion 22A to the back end portion 22C. The inclined surface of the tapered portion 22B functions as a reflection surface for reflecting shots.

The guide portion 30 has a wire hole 31, support portions 32, and shot pass holes 33. The support portions 32 extend from the wire hole 31 to the outside of radius direction. The shot pass holes 33 are formed between the support portions 32. For example, the support portions 32 are rotationally symmetric with respect to the wire hole 31. For example, the number of the support portions 32, which are spaced 120 degrees from each other, is three. Opened spaces are formed as the shot pass holes 33 between the support portions 32 next to each other. The guide portion 30 desirably has a diameter larger than that of the reflection portion 20. Since the guide portion 30 is fixed by the crimp pin 40, the movement of the guide portion 30 in an axial direction of the wire 10 is prevented even when the guide portion 30 receives impacts by shots, gas pressure, or the like. The crimp pin 40 proximate to both sides of the reflection portion 20 restricts the movement of the reflection portion 20 in the axial direction of the wire 10 within a predetermined distance.

The reflection member 1 is one example of the reflection member of the present invention. The reflection member 1 is not limited to the above feature, and it can be modified within the range of the present invention. For example, the reflection portion 20 may be fixed by a fixing means (for example, the crimp pin 40). In this feature, even when the reflection portion 20 receives impacts by shots, gas pressure, or the like, the rotation of the reflection portion 20 around the wire 10 is prevented, and the movement of the reflection portion 20 in an axial direction of the wire 10 is prevented. The shape of the blade portion 22 may be rotationally symmetric, and for example, it is conical. Alternatively, the shape of the blade portion 22 may have a reflection surface facing a predetermined direction. The blade portion 22 has a shape to reflect shots in a desired direction, and the reflection direction is determined on whether the reflection portion 20 is fixed to the wire 10 or not, and it is determined by appropriately setting of the formation position, the inclined angle of the reflection surface of the blade portion 22, and so forth.

For example, the guide portion 30 may be shaped so that shots can pass therethrough. The number of the guide portions 30 may be plural, if necessary. In this case, each position of the guide portions 30 is appropriately set. For example, a means for fixing of the guide portion 30 to the wire 10 may not be limited to the crump pin 40, and it may be another means.

B. Construction of Shot Peening Apparatus

Figure 5:
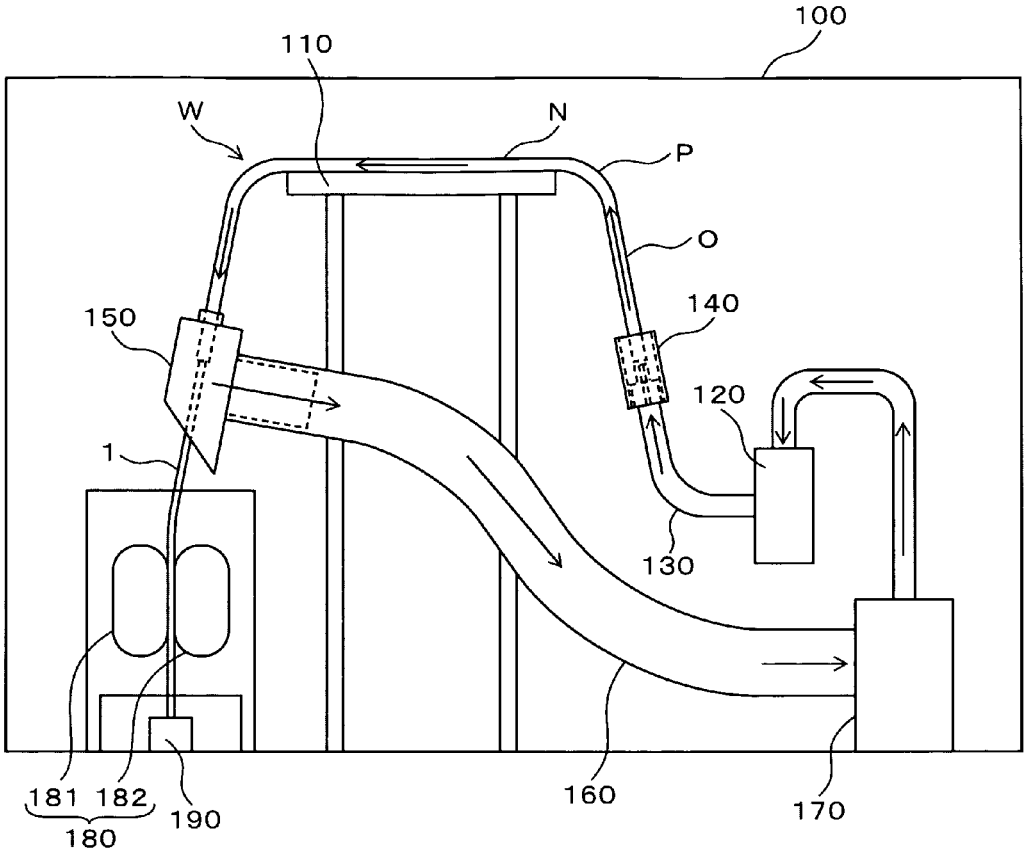
FIG. 5 is a front view showing a schematic construction of a shot peening apparatus using the reflection member of one embodiment according to the present invention.

A shot peening apparatus 100 using the reflection member 1 will be explained mainly with reference to FIG. 5. FIG. 5 is a front view showing a schematic construction of the shot peening apparatus 100 using the reflection member 1. For example, the shot peening apparatus 100 is a direct pressure type shot peening apparatus in which shots are injected and carried by a compressive gas. The shot peening apparatus 100 is equipped with a fixing pedestal 110, a shot projection device 120, a shot carrier portion 130, a shot projection portion 140, a separation portion 150, a shot collection portion 160, a collection device 170, a wire carrier mechanism 180, and a wire ejection portion 190. In FIG. 5, arrow directions show a flow direction of the shots.

For example, a hollow stabilizer as the pipe W is fixed on the fixing pedestal 110. The hollow stabilizer has a torsion portion N, arm portions O and curved portions P. The torsion portion N is fixed on the fixing pedestal 110. The arm portions O extend downwardly from both sides of the torsion portion N. The curved portions connect the torsion portion N and the arm portions O. The reflection member 1 is disposed in a hole of the pipe W. In the reflection member 1, a front end portion of the wire 10 is positioned in the wire carrier mechanism 180, and the reflection portion 20 is positioned at an entrance opening side of the hole of the pipe W. In the reflection portion 20, the front end portion 22A is positioned toward the entrance opening side of the hole of the pipe W, the back end portion 22C is positioned toward an exit opening side of the hole of the pipe W, and the reflection surface of the tapered portion 22B is inclined toward the entrance opening side of the hole of the pipe W.

The shot projection device 120 injects shots by a compressive gas. In the shot carrier portion 130, the collection device 170, the shot projection device 120, and the shot projection portion 140 are connected, and the shots are carried thereamong through the shot carrier portion 130. The shot projection portion 140 connects the entrance opening of the hole of the pipe W and the shot carrier portion 130. In the separation portion 150, the shots and the reflection member 1 are separated, the shots are collected to the collection portion 160, and the reflection member 1 is collected to wire carrier mechanism 180.

The shot collection portion 160 connects the separation portion 150 and the collection device 170. The shots ejected from the exit opening of the pipe W are carried to the collection device 170 through the shot collection portion 160. The collection device 170 removes a dust mixed with the shots, and it carries the shots to the shot projection device 120. In this case, amount of the gas collected by the collection device 170 is desirably controlled to be larger than amount of gas injected by the shot projection device 120. The wire carrier mechanism 180 has caterpillars 181 and 182 facing each other. In the wire carrier mechanism 180, the caterpillars 181 and 182 hold the wire 10 of the reflection member 1, and they rotate in a predetermined direction, so that the wire 10 is carried to the wire ejection portion 190.

The shot peening apparatus 100 is one example of an apparatus using the reflection member of the present invention, and the shot peening apparatus 100 may be another apparatus which can use the reflection member of the present invention. The pipe W is not be limited to a hollow stabilizer, and it may be a metallic pipe (for example, a hollow spring) having a hole.

2. Action of Embodiment

The action of the shot peening apparatus 100 will be explained hereinafter with reference to FIGS. 1 to 5. In the shot peening apparatus 100, the projection of the shots is performed onto the inner surface in the hole of the pipe W while the reflection portion 20 of the reflection member 1 is moved along the inner surface in the hole of the pipe W, as described hereinafter.

When the shot projection device 120 injects shots by a compressive gas, the shots are projected from the entrance opening of the hole of the pipe W through the shot carrier portion 130 and the shot projection portion 140. While the projected shots are reflected toward the inner surface in the hole by the reflection member 1, the shots move in the hole, and they are ejected from the exit opening of the hole of the pipe W. The ejected shots are collected to the shot collection portion 160, and they are carried to the collection device 170. After the dust mixed with the carried shots is removed by the collection device 170, the shots are carried to the shot projection device 120, and they are reused for the projection therefrom.

In this projection of the shots, the reflection member 1 is moved on the inner surface in the hole of the pipe W. After the start of the projection of the shots, the wire 10 of the reflection member 1 is carried to the wire ejection portion 190 by the wire carrier mechanism 180. Therefore, the reflection portion 20 of the reflection member 1 is moved on the inner surface in the hole of the pipe W from the entrance opening of the hole of the pipe W to the exit opening thereof.

In this case, the shots, which are projected toward the inner surface in the hole of the pipe W, reach the reflection portion 20 through the shot pass holes 33 of the guide portion 30 of the entrance side, and they are reflected toward the inner surface in the hole of the pipe W. In particular, in the embodiment, since the reflection portion 20 is rotatably provided, the reflection portion 20 appropriately rotates when receiving the impacts by shots, gas pressure, or the like. Since the blade portions 22 of the reflection member 22 are shaped to be rotationally symmetric with respect to the axis of the wire 10, the shots are randomly reflected toward the inner surface in the hole of the pipe W by the reflection surface of the tapered portion 22B of the blade portion 22. These shots are ejected from the exit opening of the hole of the pipe W through the shot pass holes 33 after collided to the inner surface in the hole of the pipe W.

Figure 4:
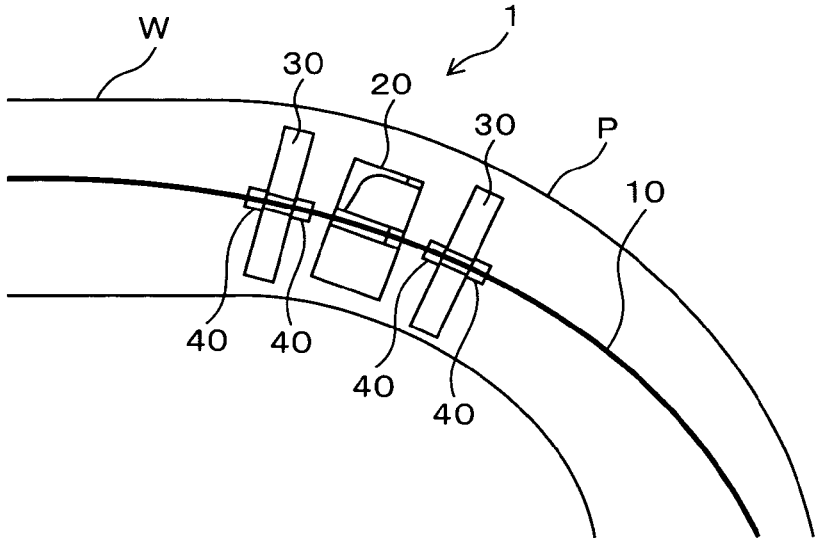
FIG. 4 is a cross sectional view showing one example of a condition in which the reflection member of the present invention passes through a curved portion of a pipe.

The reflection portion 20 is guided by the guide portion 30, which is provided at both sides of the reflection portion 20, so as to be positioned within a predetermined range from the axis of the pipe W in the hole of the pipe W. In this case, for example, the axis of the reflection portion 20 is positioned within the region proximate to the axis of the pipe W. In particular, this guide by the guide portion 30 is advantageous to the case in which the reflection portion 20 passes through the curved portion P as shown in FIG. 4. Thus, since the shots are reflected toward the inner surface inside in the hole of the pipe W by the reflection surface of the tapered portion 22B of the blade portion 22, the tendency that shots may be moved toward the inner surface outside in the hole of the curved portion P can be small. This effect can be reliably obtained in the case in which the guide portion 30 has a diameter larger than that of the reflection portion 20.

As described above, the projection of the shots is performed onto the inner surface in the hole of the pipe W while the reflection portion 20 of the reflection member 1 is moved on the inner surface in the hole of the pipe W. Thus, since the shot peening can be performed onto the overall surface of the hole of the pipe W, the processed condition of the inner surface of the pipe W can be uniform. As a result, since thinning of the wall of the pipe W can be performed, the pipe W can be strong, and the weight reduction of the pipe W can be simultaneously performed.

In this embodiment, the shot peening can be effectively performed onto the desired positions of the inner surface in the hole of the pipe W, and this effect can be obtained by using the simple structure that the reflection portion 20 and the guide portion 30 are provided around the wire 10. Since the movement of the reflection portion 20 and the guide portion 30 in the hole of the pipe W can be performed by using the wire 10, it is unnecessary to change the projection amount of the shots in accordance with the shape of the pipe W. As a result, the workability and the versatility can be improved, and the reflection member 1 can be easily used on the inner surface in the hole of the pipe W having the curved portion.

In particular, since the reflection portion 20 is rotatably provided around the wire 10, the reflection portion 20 appropriately can rotate around the wire 10 when receiving the impacts by shots, gas pressure, or the like, so that reflection efficiency can be improved. Since the amount of the gas collected by the collection device 170 is controlled to be larger than amount of gas injected by the shot projection device 120, the decrease in the movement speed on the inner surface in the hole of the pipe W can be inhibited, so that the shot peening can be effectively performed.

The explanation of the embodiment according to the present invention uses the feature in which the reflection portion 20 is sequentially moved on the inner surface in the hole of the pipe W, and the present invention is not limited to this feature, and various modifications can be used. For example, the reflection portion is stopped on the inner surface in the hole of the pipe W, and the projection of the shots is performed. Thus, the shot peening can be performed onto the desired position on the inner surface in the hole of the pipe W. In addition, this action is repeated, so that the shot peening can be performed onto plural desired positions on the inner surface in the hole of the pipe W.

EXAMPLE

The embodiment of the present invention will be explained hereinafter with reference to the example. In an example of the present invention, the shot peening apparatus shown in FIG. 5 was used, and shot peening was performed onto the inner surface in the hole of the pipe W which is a stabilizer, while the reflection member of the present invention shown in FIG. 1 was moved therein. In a comparative example, the shot peening apparatus shown in FIG. 5 was used, and shot peening was performed onto the inner surface in the hole of the pipe W in the same manner as in the example except that the reflection member of the present invention was not used. The hardness of the hollow stabilizer was about HRC (Rockwell Hardness C-Scale) 40. The wire of the reflection member was a cut wire having a diameter of 0.67 mm.

Figure 6:
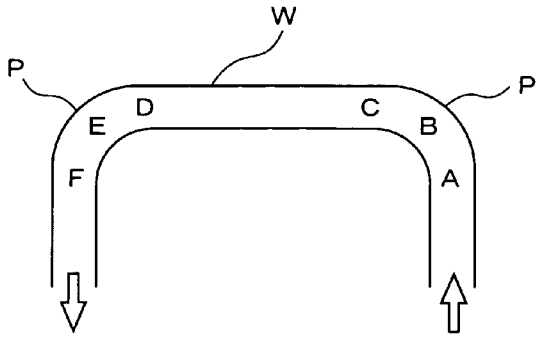
FIG. 6 is a diagram explaining a measurement point at which a residual stress is measured on a pipe.

In the example and the comparative example, the residual stress measurement was performed on the pipes W subjected to the shot peening. As shown in FIG. 6, the measurement points were the outside points and the inside points on the inner surface shown by the marks A to C of the entrance side curved portion P, and the measurement points were the outside points and the inside points on the inner surface shown by the marks D to F of the exit side curved portion P. Each arrow direction in FIG. 6 shows the shot projection side and the shot ejection side.

Figure 7:
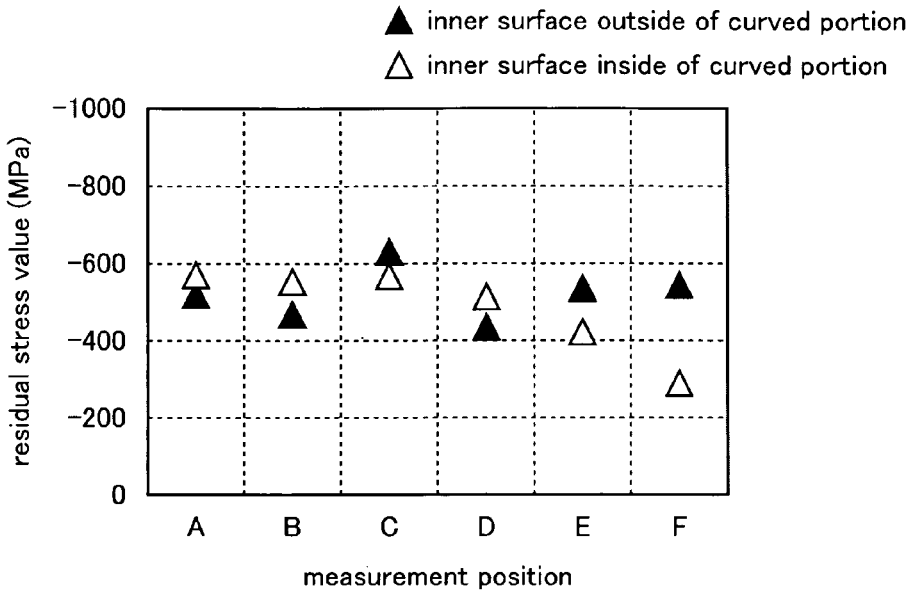
FIG. 7 is a graph showing results of residual stress measured at each measurement point of a pipe.
Figure 8:
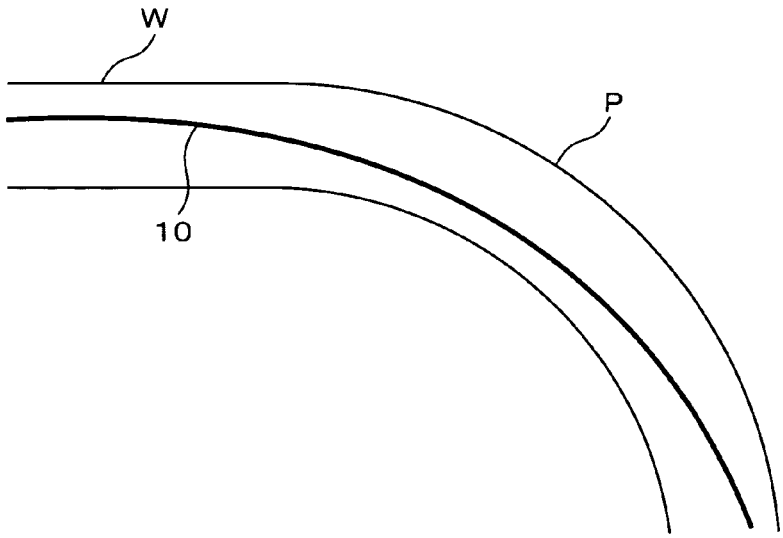
FIG. 8 is a cross sectional view showing a locus of a wire at a curved portion of pipe.
Figure 9:
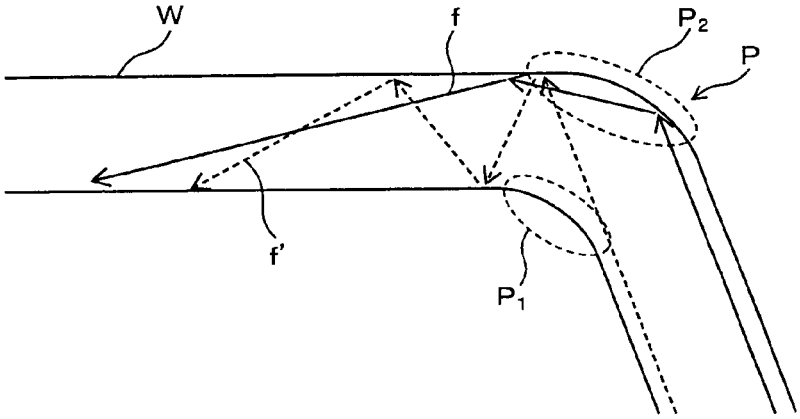
Fig. 9 Prior Art
FIG. 9 is a cross sectional view explaining a locus of shots at a curved portion of pipe in the conventional shot peening.

In the example, as shown in FIG. 7, the compressive residual stress of −300 MPa to −600 MPa was provided at overall of the outside points and the inside points on the inner surface shown by the marks A to F of the curved portion P. In contrast, in the comparative example, the compressive residual stress provided at overall of the outside points and the inside points on the inner surface shown by the marks A to F of the curved portion P was about zero.

As confirmed by the above results, when the shots were projected to the pipe having the curved portion by using the reflection member of the present invention, the shot peening could be performed onto the inner surface inside in the hole of the curved portion as effectively as onto the inner surface outside thereof. Thus, it was confirmed that the reflection member of the present invention could improve the life-span of the inner surface in the hole of the pipe and the durability thereof, and it could thereby obtain the effects of the present invention. In the example, the pipe W was not limited to the hollow stabilizer, and it may be a hollow coil spring.

What is claimed is:

1. A reflection member for colliding shots to an inner surface of a hole of a pipe in performing shot peening in order to provide a compressive residual stress to the inner surface of the hole of the pipe, comprising:

a wire;

a reflection portion that is provided around the wire and reflects the shots, thereby colliding the shots to the inner surface of the hole of the pipe; and one or more guide portions that are fixed at both sides of the reflection portion around the wire, have a hole through which the shots pass in an axial direction of the wire, and guide the reflection portion on the inner surface of the hole of the pipe.

2. The reflection member, according to claim 1, wherein the reflection portion is rotatably provided around the wire.

3. The reflection member, according to claim 1, wherein the number of the portions provided at both sides of the reflection portion around the wire is plural.

4. A shot peening method comprising the steps of:

projecting shots into a hole of a pipe; and reflecting the shots by the reflection portion of the reflection member according to claim 1, thereby colliding the shots to an inner surface of the hole of the pipe.

5. The shot peening method according to claim 4, wherein the pipe has at least one of curved portions.

6. The shot peening method according to claim 4, wherein the wire is moved on the inner surface in the hole of the pipe along an axial direction of the hole of the pipe during the projecting of the shots.

7. The shot peening method according to claim 4, wherein in the projecting of the shots, the shots are injected from one of two openings of the hole of the pipe into the hole of the pipe by using an injection device, and in the reflecting of the shots, the shots are reflected toward the inner surface in the hole by the reflection portion, and the shots are collided to the inner surface of the hole of the pipe, so that shot peening is performed on the inner surface in the hole of the pipe, wherein the shot peening method further comprises the step of:

collecting the shots, which are ejected from another of the two openings of the hole, by using a collection device, wherein an amount of gas collected by the collection device is controlled to be not less than an amount of gas injected by the injection device.

8. A shot peening apparatus for performing shot peening in order to provide a compressive residual stress to an inner surface of a hole of a pipe, comprising:

an injection device that projects shots into the hole of the pipe; and the reflection member according to claim 1 disposed in the hole of the pipe.

* * * * *